US006886868B2

(12) United States Patent
Hengelein et al.

(10) Patent No.: US 6,886,868 B2
(45) Date of Patent: May 3, 2005

(54) DOOR-LOCKING ASSEMBLY

(75) Inventors: Günter Hengelein, Altdorf (DE); Hubert Harrer, Hilpoltstein (DE)

(73) Assignee: Ellenberger & Poensgen GmbH, Altdorf (DE)

( * ) Notice: Subject to any disclaimer, the term of this patent is extended or adjusted under 35 U.S.C. 154(b) by 0 days.

(21) Appl. No.: 10/751,594

(22) Filed: Jan. 5, 2004

(65) Prior Publication Data

US 2004/0140677 A1 Jul. 22, 2004

Related U.S. Application Data

(63) Continuation of application No. PCT/EP02/12247, filed on Nov. 2, 2002.

(30) Foreign Application Priority Data

Nov. 8, 2001 (DE) ..... 101 54 850

(51) Int. Cl.[7] ..... E05C 3/06

(52) U.S. Cl. ..... 292/201; 292/97; 292/99; 292/DIG. 66; 292/DIG. 69

(58) Field of Search ..... 292/DIG. 66, 201, 292/95, 97, 99, DIG. 69

(56) References Cited

U.S. PATENT DOCUMENTS

| | | | | | |
|---|---|---|---|---|---|
| 3,540,767 | A | * | 11/1970 | Siegel | 292/210 |
| 3,617,957 | A | * | 11/1971 | Brighenti | 337/77 |
| 3,859,979 | A | * | 1/1975 | Gilliom | 126/197 |
| 4,179,907 | A | * | 12/1979 | Schantz | 68/12.26 |
| 4,286,811 | A | * | 9/1981 | Schantz | 292/201 |
| 4,620,735 | A | * | 11/1986 | Heydner | 292/144 |
| 4,717,794 | A | * | 1/1988 | Paul et al. | 200/50.1 |
| 4,718,705 | A | * | 1/1988 | Case | 292/201 |
| 4,861,078 | A | * | 8/1989 | Munoz | 292/113 |
| 4,988,132 | A | * | 1/1991 | Rocchitelli | 292/144 |
| 4,995,650 | A | * | 2/1991 | Schantz et al. | 292/201 |
| 5,029,910 | A | * | 7/1991 | Genbauffe et al. | 292/110 |
| 5,419,305 | A | * | 5/1995 | Hanley | 126/197 |
| 6,334,637 | B1 | * | 1/2002 | Chioffi | 292/341.16 |
| 6,345,848 | B1 | * | 2/2002 | Baader et al. | 292/341.16 |

FOREIGN PATENT DOCUMENTS

| | | |
|---|---|---|
| DE | 196 01 230 A1 | 7/1997 |
| DE | 198 08 848 A1 | 10/1998 |
| DE | 198 34 844 A1 | 10/1999 |
| DE | 199 15 669 A1 | 10/2000 |
| EP | 0 384 148 B1 | 8/1990 |

* cited by examiner

*Primary Examiner*—Daniel P. Stodola
*Assistant Examiner*—Carlos Lugo
(74) *Attorney, Agent, or Firm*—Lawrence A. Greenberg; Werner H. Stemer; Gregory L. Mayback

(57) ABSTRACT

A door latch is particularly suited for a washing machine door. The device has a pivotally mounted rotary catch for latching onto a locking element and a pivotally mounted blocking or arresting element. The latter is pivotally mounted between a latching position that latches the rotary catch and an unlatching position that releases the rotary catch. The arresting element can be actuated by a bimetallic adjusting element, which can be heated by a heating element, and by an actuator system that, at the same time, is actively connected to the turning catch in a direct manner. A torque component effected on the arresting member by the actuator system is greater in value that a torque component introduced by the bimetallic adjusting element.

10 Claims, 6 Drawing Sheets

DOOR-LOCKING ASSEMBLY

CROSS-REFERENCE TO RELATED APPLICATION

This application is a continuation of copending International Application No. PCT/EP02/12247, filed Nov. 2, 2002, which designated the United States and which was not published in English.

BACKGROUND OF THE INVENTION

Field of the Invention

The invention relates to a door-locking device, in particular for a washing-machine door, having a pivotally mounted rotary catch for locking a locking member, and having a pivotally mounted arresting member which can be pivoted between a locking position, in which the rotary catch is locked, and an unlocking position, in which the rotary catch is released.

Such a door-locking device is known, for example, from German patent DE 198 34 844 C2. A pawl, which can be actuated by an electromagnet, is provided there in order to block the arresting member. A multiplicity of active levers results in a substantial reduction in a force to which the locking member is subjected in the opening direction until the point at which the pawl engages on a blocking surface of the arresting member. However, a mechanism which takes effect in the event of a power failure and takes account, in particular, of safety-related aspects is not provided.

A door-locking device for a washing-machine door which displays a defined behavior in the event of a power failure is known, for example, from German published patent application DE 199 15 669 A1. During the operation of the washing machine, a bimetallic snap-action disc is heated by an electric heating element, the snap-action disc being connected to a rocker which, via a securing element, can block or release a blocking slide of the door-locking device. At the beginning of the washing operation, the bimetallic snap-action disc is heated, with the result that, following a heating-up phase of the snap-action disc, the rocker is actuated and the door-locking device is thus blocked in the closed position. Following completion of the washing operation, the door-locking device remains blocked in the first instance on account of the heated bimetallic snap-action disc. This effect, which is active even in the event of a power failure, serves to prevent premature opening of the washing-machine door, in particular when the drum is moving. Once the snap-action disc has cooled, the door-locking device is released again. The predetermined blocking period, in which the door-locking device remains blocked, has to be such here that, for each selectable washing program and each possible drum load, the door-locking device remains blocked for a sufficiently long period of time. On account of this non-variable blocking period, there are operating modes in which the door-locking device remains blocked for an unnecessarily long period of time.

A door-locking configuration for washing machines or laundry driers in which the period of time over which the locking device remains blocked following completion of the washing or drying operation is variable is known, for example, from European patent EP 0 384 148 B1. The blocking of the locking device there is dependent on characteristic variables of the machine, such as temperature and the level of the washing bath and the rotational speed of the drum. Safety-related requirements, however, are not sufficiently fulfilled since there is no defined behavior in the event of a power failure.

SUMMARY OF THE INVENTION

It is accordingly an object of the invention to provide a door locking assembly, which overcomes the above-mentioned disadvantages of the heretofore-known devices and methods of this general type and which is particularly suitable for a washing-machine door and which allows controllable blocking and has emergency locking properties which do not depend on an energy supply.

With the foregoing and other objects in view there is provided, in accordance with the invention, a locking device, in particular for a washing machine door. The device comprises:

a pivotally mounted rotary catch for locking a locking member;

a pivotally mounted arresting member to be pivoted between a locking position, wherein the rotary catch is locked, and an unlocking position, wherein the rotary catch is released;

a bimetallic actuator element disposed to effect a first torque on the arresting member for actuating the arresting member, and a heating element for heating the actuator element; and an actuator system in direct operative connection with the rotary catch and disposed to effect a second torque on the arresting member for actuating the arresting member;

the second torque transmitted to the arresting member by the actuator system being greater than the first torque transmitted to the arresting member by the bimetallic actuator element.

In other words, the objects are achieved by a door-locking device having a pivotally mounted rotary catch contains a likewise pivotally mounted arresting member which can be actuated both by a bimetallic adjusting element, which is heatable by a heating element, and by an actuator system, the actuator system at the same time being in operative connection with the rotary catch. The actuator system here acts on the rotary catch directly, that is to say without going via the arresting member. Since the arresting member is in operative connection both with the actuator system and with the bimetallic adjusting element, it is possible to realize a design with a small number of movable parts. The rotary catch, meanwhile, can be blocked a locking member, for example, a clamp of a washing-machine door, locking position by the actuator system and/or by the bimetallic adjusting element acting on the arresting member.

The pivotally mounted arresting member may be subjected to a torque both via the actuator system and via the bimetallic adjusting element. The torque which can be transmitted by the actuator system is larger than the torque which can be transmitted by the bimetallic adjusting element. It is thus always possible for the controllable actuator system, on condition that the energy supply is undisturbed, to render the bimetallic adjusting element inoperative.

In particular, following completion of the washing program, with the bimetallic adjusting element still heated up, the blocking of the locking device may be eliminated as soon as this is readily possible from a safety standpoint, on account of the operating state of the washing machine, and the actuator system receives a corresponding control signal.

The bimetallic adjusting element may be limited to a safety-related emergency function. In the event of a power failure and thus of the actuator system failing, the locking device remains blocked until the bimetallic adjusting element has cooled to a sufficient extent and releases the rotary catch via a pivoting movement of the arresting member.

Since this securing mechanism takes effect exclusively in the event of a power failure, a blocking period of the bimetallic adjusting element, which may contain additional safety reserves, does not prove disadvantageous during intended operation of the washing machine. A heating-up phase of the heating element and of the bimetallic adjusting element once power has begun to be supplied is not relevant from a safety standpoint since the rotary catch can be blocked directly by the actuator system and blocking is thus possible immediately once the washing-machine door has been closed.

A particularly straightforward configuration of the actuator system is preferably achieved by the latter being designed as a double magnet system. By virtue of this design, it is possible for a magnetic core to act directly both on the arresting member and on the rotary catch. The actuator system and arresting member may interact here such that the actuator system can cause the arresting member to be pivoted from its locking position into its unlocking position, but not vice versa. In other words, only the bimetallic adjusting element is provided for locking the arresting member, while both the bimetallic adjusting element and the actuator system are provided for unlocking the arresting member.

In order to detect the position of the rotary catch, an electrical locking contact is advantageously provided, this being closed, for example, when the rotary catch is closed, that is to say when the locking member is locked. Furthermore, a door-position-dependent contact system is provided in addition, or as an alternative, according to a preferred configuration, the contact system being triggered, irrespective of the position of the rotary catch, by a door-position-dependent slide. Both the electrical locking contact and the door-position-dependent contact system are preferably connected to a machine-control means, it also being possible to realize a connection to a higher-level communications system, for example, via an installation bus.

Manual unlocking of the arresting member and thus of the rotary catch is not necessary in principle; this also applies in the event of a power failure. In order for it to be possible, however, to unlock the arresting member following a shortened waiting period, for example following a power failure, an advantageous development provides an emergency unlocking device which allows the arresting member to be unlocked, even counter to the action of the bimetallic adjusting element.

The door-locking arrangement performs both mechanical and electrical functions. In order to perform these functions equally, the arrangement, according to a preferred embodiment, contains a metallic base plate which can be subjected to mechanical loading and to which it is possible to connect in modular fashion a drive unit which is produced from plastic and accommodates the electrical and electronic and electromechanical components. The modular construction makes it possible for a drive unit to be connected to different base plates, for example different types of washing machine.

A printed circuit board is advantageously provided for connection of the electrical, electronic and electromechanical components, such as the door-position-dependent contact system, electrical locking contract, heating element, bimetallic adjusting element and actuator system. The individual components here may either be fitted directly on the printed circuit board or connected to the latter, for example, via plug-in contacts. The printed circuit board is also suitable for connection of a compact plug connector, via which both the lines for supplying power to the door-locking device and the signal lines can be connected. Designing the door-locking device with a single compact plug connector facilitates installation in relation to an arrangement with a plurality of connections, the risk of incorrect installation, at the same time, being virtually eliminated.

Other features which are considered as characteristic for the invention are set forth in the appended claims.

Although the invention is illustrated and described herein as embodied in a door-locking device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
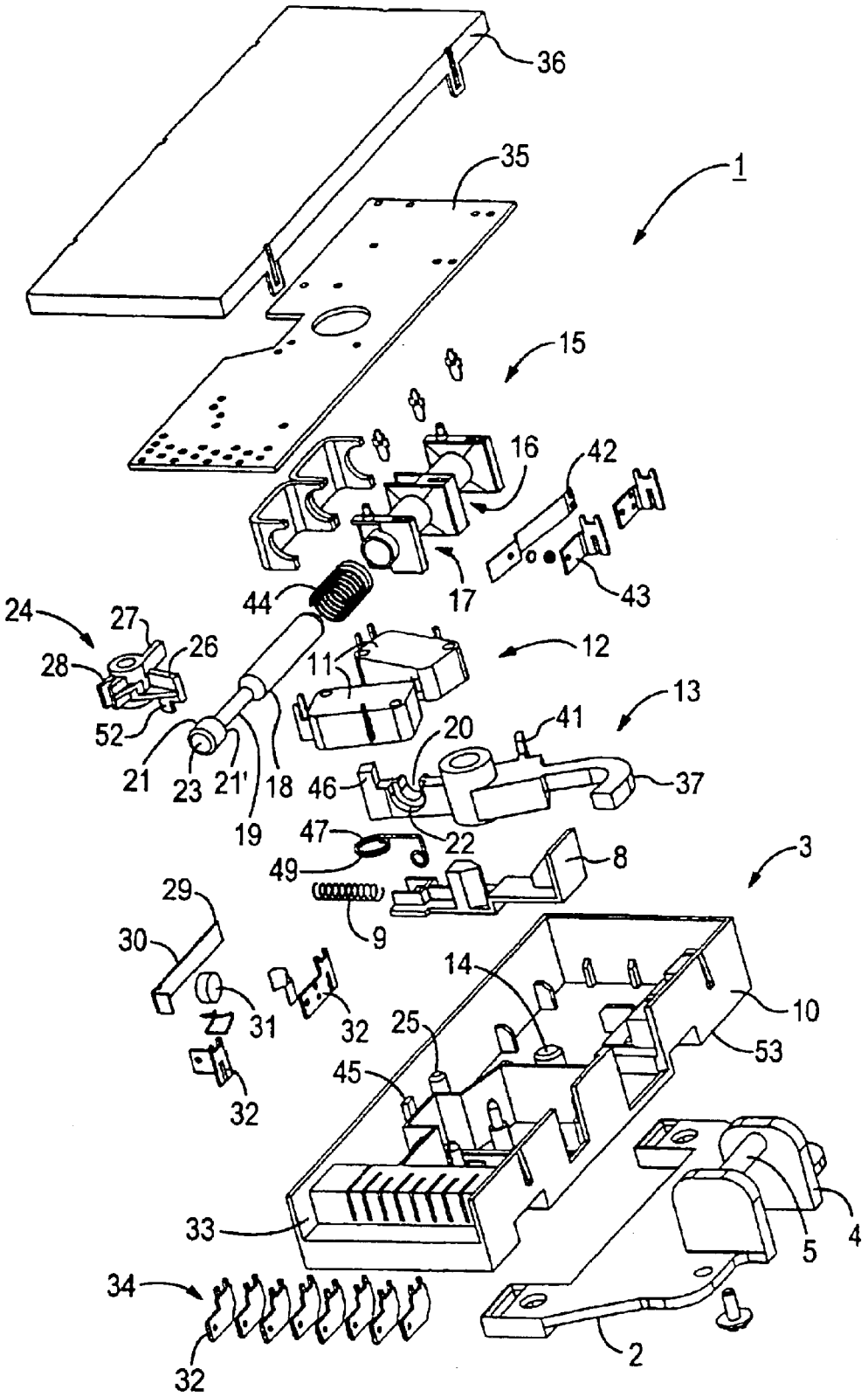
FIG. 1 is an exploded perspective view of a door-locking device according to the invention.

Referring now to the figures of the drawing in detail and first, particularly, to FIG. 1 thereof, there is shown the door-locking device 1 with its most significant components. A base plate 2 made of metal, for example die-cast zinc, can be connected, in particular screw-connected, to a housing 3 which is made of plastic and forms a drive unit. It is likewise possible for the base plate 2 to be connected, in particular screw-connected, to a non-illustrated washing-machine housing. Furthermore, the base plate 2 has a bolt 5 that is retained between two side pieces 4 and on which a locking member or clamp 6 (FIG. 4) can act. The clamp 6, furthermore, acts on a door-position-dependent slide 8, which is connected to a spring 9. The slide 8 passes through the right-hand actuating side 10 of the housing 3, as seen in the illustration. The spring 9 forces the slide 8 in the direction of the bolt 5. Microswitches 11, which are parts of the door-position-dependent contact system 12, are arranged in the housing 3, on both sides of the slide 8.

Also in the housing 3, a rotary catch 13 is mounted such that it can be pivoted on a swivel pin 14. An actuator system 15 designed as a double magnet system is provided for actuating the rotary catch 13. A top coil 16 and a bottom coil 17 are provided for displacing an essentially cylindrical magnetic core 18. A tapered region 19 of the magnetic core 18 passes through a semicircular cutout 20 of the rotary catch 13. The tapered region 19 of the magnetic core 18 is adjoined by a head part 21 which, by way of its annular top border 21', can act on a semicircular bearing surface 22 of the rotary catch 13, this surface enclosing the cutout 20. The underside 23 of the head part 21 is provided for actuating an arresting member 24, which is mounted such that it can be pivoted about a swivel pin 25. The swivel pin 14 of the rotary catch 13 and the swivel pin 25 of the arresting member 24 are parallel to one another in the exemplary embodiment. In contrast, it is also possible for the swivel pins 14, 25 to be arranged in different planes enclosing an angle, in particular a right angle.

The arresting member 24 has an actuating arm 26 for actuation by the magnetic core 18, a blocking arm 27 for blocking the rotary catch 13, and a fork arm 28 for accommodating an end 29 of a bimetallic actuator or adjusting element 30. The bimetallic actuator element 30 can be heated by a PTC (positive temperature coefficient) heating element 31, which butts directly against the bimetallic actuator element 30. Contacts 32 are provided for supplying power to the heating element 31. A voltage is applied to the heating element 31 via the contacts 32 and via the bimetallic adjusting element 30. All the contacts 32 of the housing 3, which are guided in the outward direction, are combined in a compact plug connector 34 on the connection side 33 of the housing. The connections 32 of the compact plug connector 34 are connected to a printed circuit board 35 as a support for the electrical and electronic components. The printed circuit board 35 is located beneath a covering 36 of the housing 3.

Figure 2:
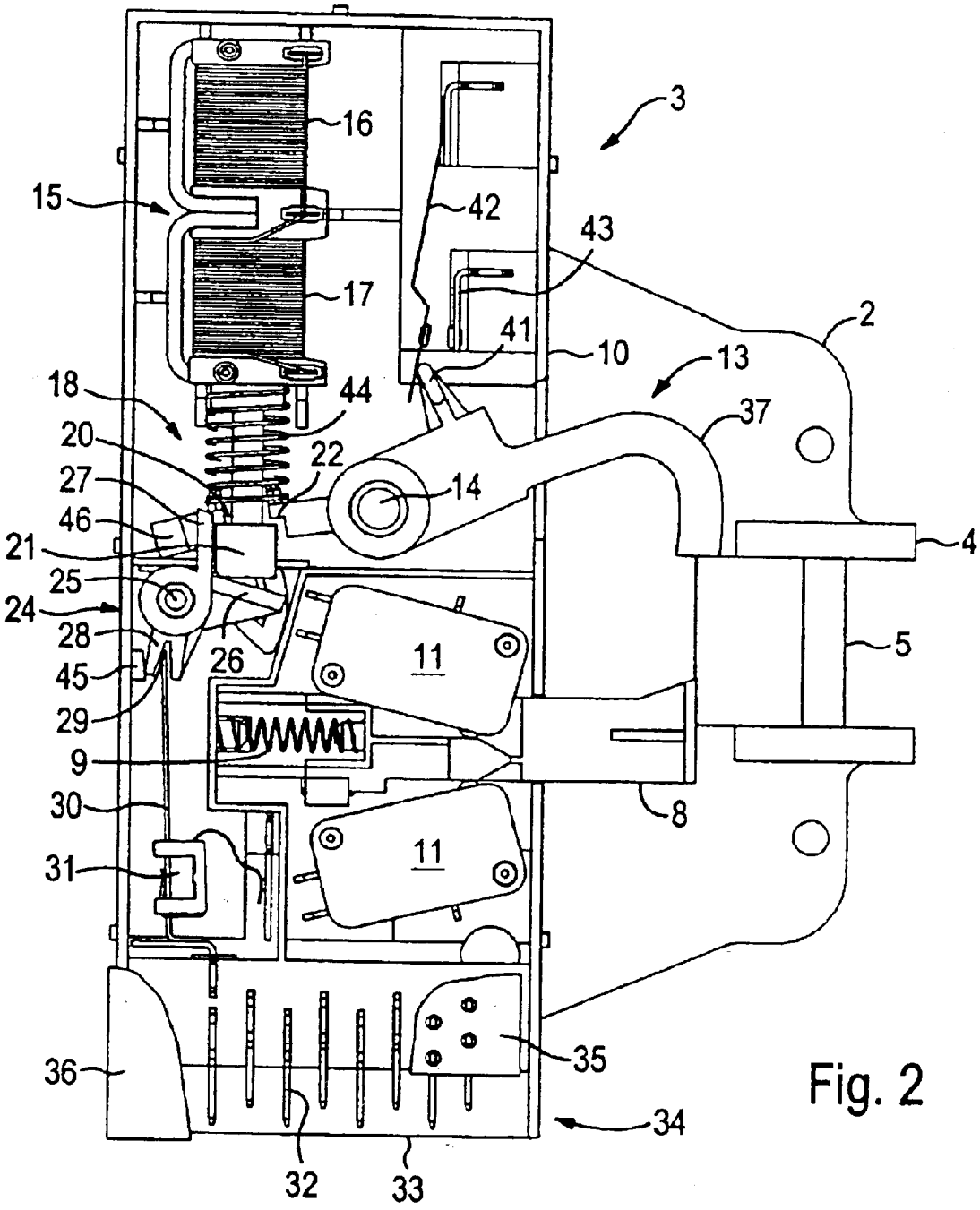
FIG. 2 is a schematic view of a section through the door-locking device with the rotary catch open.
Figure 3:
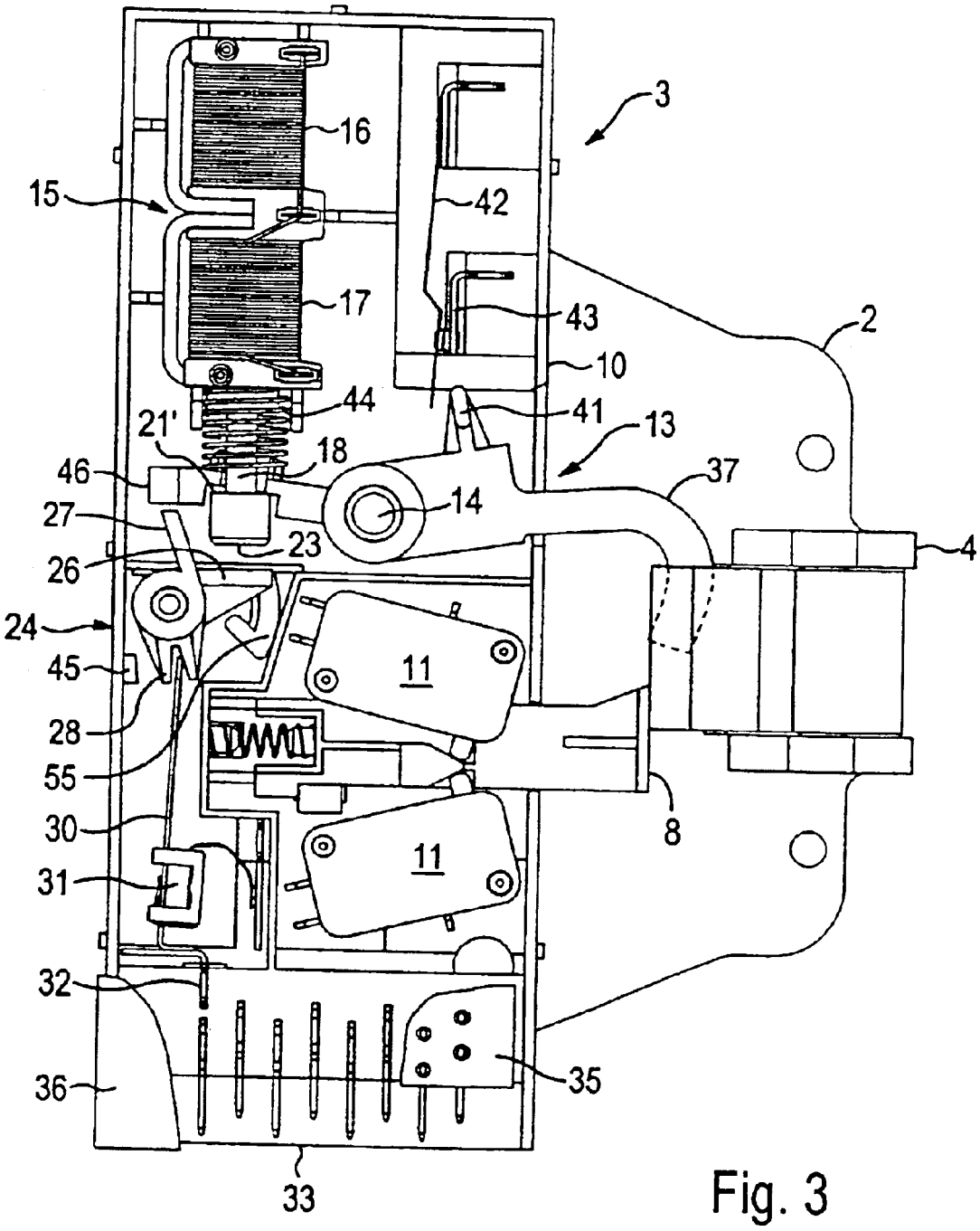
FIG. 3 is a similar view with the rotary catch closed.
Figure 4:
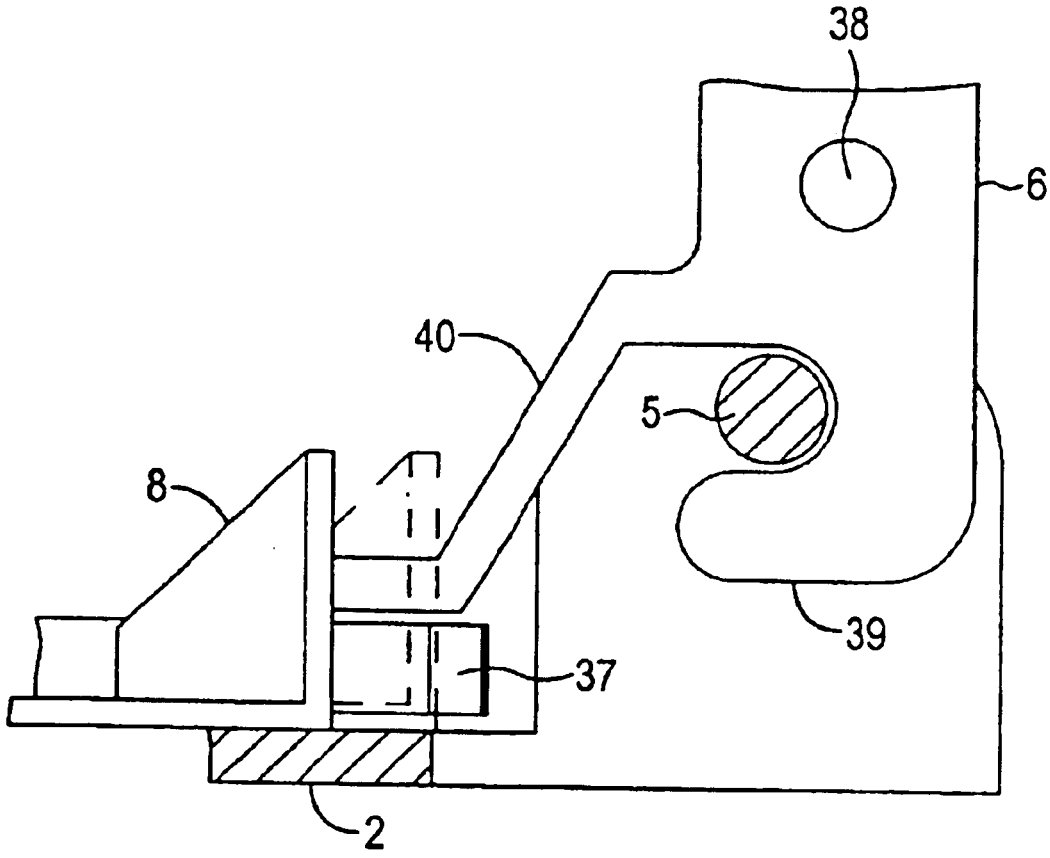
FIG. 4 is a schematic detail view of a locking member and a slide.
Figure 5:
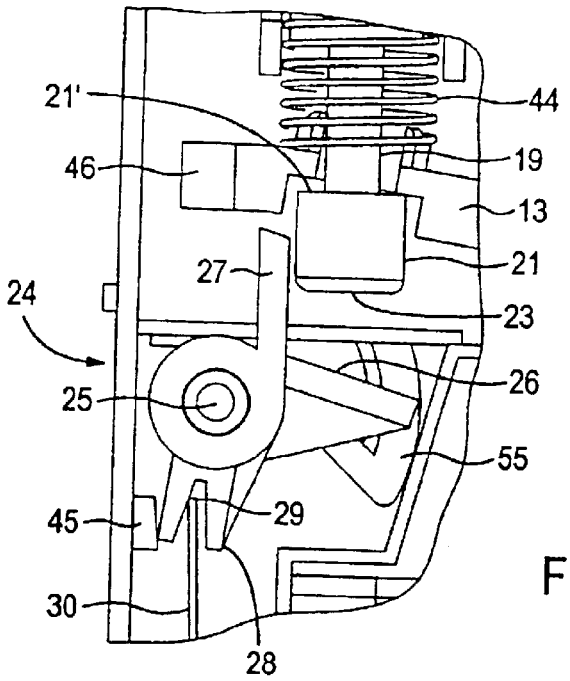
FIG. 5 is a side view of an arresting member in the unlocking position and, in detail form, a rotary catch and an actuator system.

The functions of the rotary catch 13 can be seen in more detail from FIGS. 2 to 4. The rotary catch 13 has a hook 37 which projects out of the housing 3 on the actuating side 10 of the latter and, with the door of the washing machine closed and the locking member 6 locked, engages beneath the latter (FIG. 4) and thus blocks the same. The locking member 6 can be pivoted about a point of rotation 38 and has a hook 39, which engages around the bolt 5 and a carry-along element 40, which forces the slide 8 into the housing 3. In the open position of the rotary catch 13 (FIG. 2), a contact arm 41 keeps a resilient locking contact 42 at a distance apart from a fixed locking contact 43. The locking contacts 42, 43, like the door-position-dependent contact system 12, are connected to a non-illustrated control device which allows, for example, the washing operation to begin only when the locking contacts 42, 43 are closed.

A restoring spring 44, which is configured as a helical spring, is clamped in between the actuator system 15 and the locking lever 13 in the region of the semicircular cutout 20 and encloses the magnetic core 18, subjects the rotary catch 13 to a force in the direction of the open position, which is illustrated in FIG. 2. In order to close the rotary catch 13, the magnetic core 18 is attracted, with the result that the restoring spring 44 is compressed. The arresting member 24 does not have any function during this operation. Without any power being supplied, the bimetallic adjusting element 30 is prestressed such that it forces the fork arm 28 of the arresting member 24 in the direction of a stop 45 which is located in the housing 3 opposite the actuating side 10. The arresting member 24 is thus subjected to a torque in the clockwise direction. If the bimetallic adjusting element 30 is heated via the heating element 31, then the bimetallic adjusting element 30 is deflected in the direction of the actuating side 10 and the arresting member 24 is thus rotated in the counterclockwise direction. Actuation of the rotary catch 13 by the arresting member 24 is not envisaged. The arresting member 24 is only rotated into the locking position by the bimetallic adjusting element 30 if the rotary catch 13 has already been moved into the locking position (FIG. 3) by the actuator system 15. The actuator system 15 is configured as double magnet system in order for it to be possible to subject the magnetic core 18 to force, in a controlled manner, in both directions. As an alternative, it is also possible to realize a straight-forward magnet system with a correspondingly configured spring for producing a force in the opposite direction.

Figure 6:
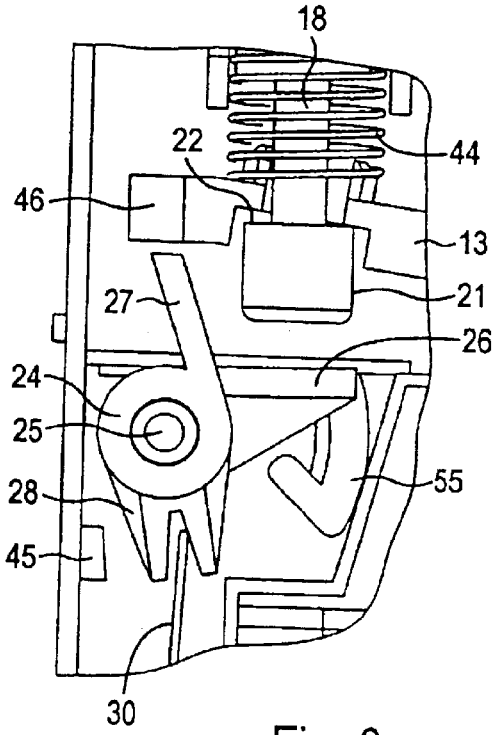
FIGS. 6 and 7 are similar view showing the arresting member in the locking position.
Figure 7:
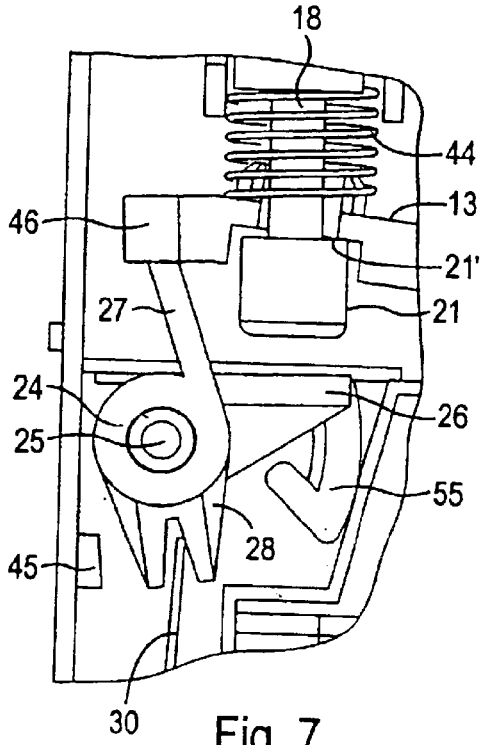

As the arresting member 24 is pivoted into its locking position (FIGS. 3, 6 and 7), the blocking arm 27 is positioned beneath a protrusion 46 of the rotary catch 13. The blocking arm 27 is offset axially in relation to the actuating arm 26, in respect of the pin 25 of the arresting member 24. If the power supply of the actuator system 15 fails, then the restoring spring 44 forces the rotary catch 13 in the direction of its open position, in which case, following a merely very short adjustment path of the rotary catch 13, the blocking arm 27 blocks the rotary catch 13 in its closed position (FIG. 7). The blocking arm 27 here butts against the protrusion 46 such that, in order to eliminate the blocking, it is necessary for the rotary catch 13 to be raised slightly counter to the action of the restoring spring 44. This reliably prevents a situation where the blocking is released accidentally, for example on account of vibrations of the washing machine. The blocking is only eliminated when the bimetallic adjusting element 30 cools and forces the fork arm 28 of the arresting member 24 in the direction of the stop 45. On account of the configuration of the individual levers 13, 27, 28 only a small force, which can be applied by the bimetallic adjusting element 30 without auxiliary power, is necessary for this purpose.

During regular operation, with a sufficient power supply, the torque which can be applied to the arresting member 24 by the actuator system 15, via the magnetic core 18 and the actuating arm 26, is larger than the torque which can be applied to the arresting member 24 by the bimetallic adjusting element 30. In other words, the controlled actuation of the rotary catch 13 by the actuator system 15 is always achieved counter to the passive bimetallic adjusting element 30.

Figure 8:
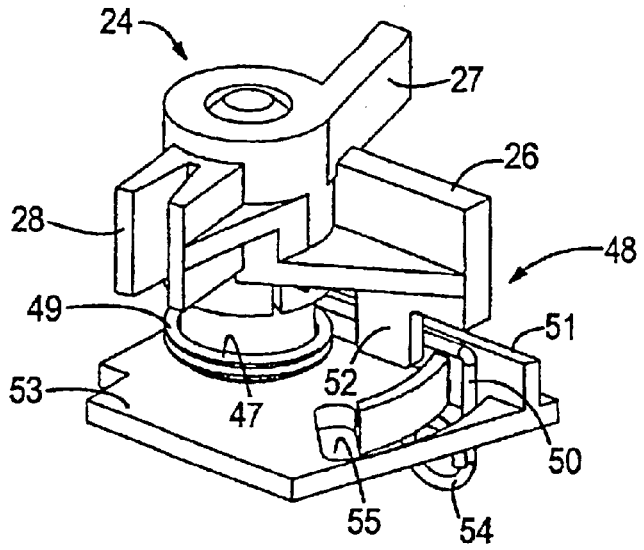
FIG. 8 is a perspective view of the arresting member with an emergency unlocking spring.
Figure 9:
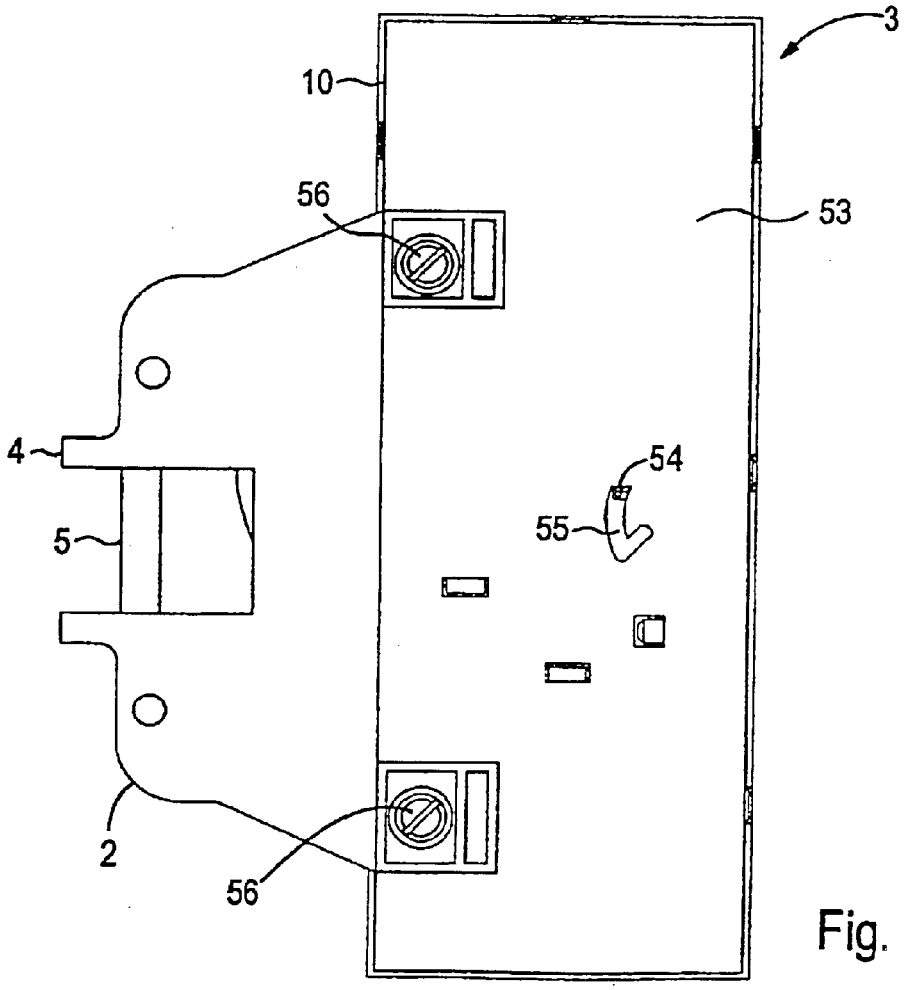
FIG. 9 is a rear view of the door-locking device.

In order for it to be possible to unlock the arresting member 24 even when the power supply has failed and the bimetallic adjusting element 30 is still heated, an emergency unlocking device 48 (FIG. 8) comprising an emergency unlocking spring 47 is provided. The emergency unlocking spring 47 has a spring turn 49, which is arranged concentrically around the swivel pin 25, and an arm 50 which is integrally formed on the spring turn and butts against a strip 51 of the housing 3. A protrusion 52 of the actuating arm 26 butts against the arm 50. A lug 54 which projects out of the housing 3 on the rear wall 53 of the same (FIG. 9) is integrally formed on the arm 50. By virtue of the arm 50 and thus the actuating arm 26 being moved through a window 55 in the rear wall 53 of the housing 3, for example, by means of a cable pull (not illustrated), it is possible to release the blocking of the arresting member 24. FIG. 9 also shows that the housing 3 is connected to the base plate 2 by screws 56.

We claim:

1. A locking device, comprising:

a pivotally mounted rotary catch for locking a locking member;

a pivotally mounted arresting member to be pivoted between a locking position, wherein said rotary catch is locked, and an unlocking position, wherein said rotary catch is released;

a bimetallic actuator element disposed to effect a first torque on said arresting member for actuating said arresting member, and a heating element for heating said actuator element; and an actuator system in direct operative connection with said rotary catch and disposed to effect a second torque on said arresting member for actuating said arresting member;

the second torque transmitted to said arresting member by said actuator system being greater than the first torque transmitted to said arresting member by said bimetallic actuator element.

2. The locking device according to claim 1 configured as a door-locking device for a washing-machine door.

3. The locking device according to claim 1, wherein said actuator system is a double magnet system.

4. The locking device according to claim 1, which comprises an electrical locking contact operatively connected with said rotary catch.

5. The locking device according to claim 1 configured as a door-locking device, and further comprising a door-position-dependent slide in operative connection with a door-position-dependent contact system.

6. The locking device according to claim 1, which further comprises an emergency unlocking device operatively connected with said arresting member.

7. The locking device according to claim 1, which further comprises a drive unit connectible in modular fashion to a base plate, wherein said actuator system is disposed in said drive unit.

8. The locking device according to claim 7, wherein said base plate is formed of metallic material.

9. The locking device according to claim 1, which further comprises a printed circuit board for connection of at least one of the following components: an electrical locking contact, a door-position-dependent contact system, a heating element, a bimetallic adjusting element, and an actuator system.

10. The locking device according to claim 9, which further comprises a compact plug connector connected to said printed circuit board.

* * * * *